US010344963B1

(12) United States Patent
Mobed et al.

(10) Patent No.: US 10,344,963 B1
(45) Date of Patent: Jul. 9, 2019

(54) EAR CUP CUSTOMIZATION

(71) Applicant: BOSE CORPORATION, Framingham, MA (US)

(72) Inventors: Darius Mobed, Watertown, MA (US); Joel H. Miller, Westborough, MA (US); Joseph Titlow, Bedford, MA (US); Jesse Flack, Sudbury, MA (US); Lee Zamir, Cambridge, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/982,063

(22) Filed: May 17, 2018

(51) Int. Cl.
*F21V 33/00* (2006.01)
*H04R 1/10* (2006.01)
*H04R 1/02* (2006.01)

(52) U.S. Cl.
CPC ..... *F21V 33/0056* (2013.01); *H04R 1/028* (2013.01); *H04R 1/1008* (2013.01)

(58) Field of Classification Search
CPC .. H04R 1/1008; H04R 1/1041; H04R 1/1075; H04R 5/033; H04R 1/1091; H04R 1/028; H04R 5/0335; H04R 1/1033; H04R 1/1058; H04R 1/1066; H04R 2420/07; H04R 1/10; H04R 1/1083; H04R 1/1016
USPC ..... 381/371, 380, 389
See application file for complete search history.

(56) References Cited

U.S. PATENT DOCUMENTS 7,377,666 B1 * 5/2008 Tyler ..... A61F 11/14 362/105

* cited by examiner

*Primary Examiner* — Curtis A Kuntz
*Assistant Examiner* — Julie X Dang
(74) *Attorney, Agent, or Firm* — Patterson + Sheridan, LLP

(57) ABSTRACT

Aspects of the present disclosure provide a headphone assembly having a customizable ear cups. Specifically, a user may customize an outer surface of an ear cup assembly by selecting one or more of color to be illuminated on the outer surface and an insert. The insert further diffuses the illuminate light. A trim ring that secures the insert is configured to overlay the lightpipe and a portion of an ear cup subassembly regardless of the presence of the insert.

20 Claims, 7 Drawing Sheets

EAR CUP CUSTOMIZATION

TECHNICAL FIELD

Aspects of the present disclosure generally relate to customization of an ear cup assembly of a headphone assembly. As described herein, a combination of customizations are selected by a user.

BACKGROUND

Customers view products as form of self-expression. Consumer products provide a platform to customize everyday products according to a consumer's desired needs or preferences. Consumers may feel more connected to products they are able to help create or customize. Traditionally, customization is a time-intensive and costly process between a supplier and the consumer. For example, a specific consumer's preferences need to be understood prior to creating the product according to the consumer's specifications. As the demand for consumer choice increases, there is a need for continued improvement in customization features available for consumer products, such as audio headphones.

SUMMARY

All examples and features motioned herein can be combined in any technically possible manner.

Certain aspects provide an ear cup assembly of a headphone assembly comprising an ear cup subassembly, a reflector positioned on an outer surface of the ear cup subassembly, a lightpipe positioned on an outer surface of the reflector, and a trim ring positioned along an outer perimeter of an exposed surface of the lightpipe, wherein the trim ring is configured to at least partially overlay the ear cup subassembly, the reflector, and the lightpipe with or without a customizable insert positioned between the lightpipe and the trim ring.

According to an aspect, the trim ring comprises an elastomeric ring configured to stretch around the outer perimeter of the exposed surface of the lightpipe with or without the customizable insert positioned between the lightpipe and the trim ring.

According to an aspect, at least a portion of the trim ring is in contact with an outer perimeter of the ear cup subassembly. According to an aspect, a thickness of the customizable insert is less than or equal to approximately 1.5 mm. According to an aspect, the customizable insert comprises a semi-transparent insert. According to an aspect, the customizable insert comprises an insert including a pattern that diffuses light illuminated from the lightpipe. According to an aspect, a thickness of the trim ring is approximately 1.5 mm. According to an aspect, the trim ring comprises a silicone trim ring.

According to an aspect, the ear cup assembly further comprises a light source and at least one processor, wherein the light source is coupled to the at least one processor and the lightpipe and a wireless communication unit coupled to the at least one processor. The wireless communication unit is configured to receive, from a source device, a request to change a color displayed by the light source and illuminated by the lightpipe, and the at least one processor is configured to update an output of the light source based at least in part on the received request to change the color.

According to an aspect, the color is selected from a combination of preset-colors. According to an aspect, the wireless communication unit is configured to receive a request to save one or more colors to be displayed by the light source as favorite selections, receive a command to cycle through the favorite selections, receive a user selection of one color from the favorite selections, and control the light source to illuminate the selected color.

According to an aspect, the request to change the color comprises a captured image comprising the color to be displayed by the light source. According to an aspect, the request to change the color comprises one of: discrete red, green, and blue values representing the color, or a singular value corresponding to the color in a lookup table.

According to an aspect, the wireless communication unit is further configured to receive, from the source device, a request to save the updated color. The ear cup assembly saves the updated color in response to the request.

Certain aspects provide an ear cup assembly of a headphone comprising an ear cup subassembly, a reflector positioned on an outer surface of the ear cup subassembly, a lightpipe positioned on an outer surface of the reflector, and a semi-transparent trim ring positioned along an outer perimeter of an exposed surface of the lightpipe, wherein the trim ring is configured to at least partially overlay the ear cup subassembly, the reflector, and the lightpipe with or without a customizable insert positioned between the lightpipe and the trim ring, and wherein the ear cup assembly receives an indication of a color from an application user device and processes the indication to determine at least one color to illuminate the lightpipe.

According to an aspect, the at least one color illuminates at least a portion of the trim ring and at least a portion of the trim ring is in contact with an outer perimeter of the ear cup subassembly. According to an aspect, the trim ring comprises an elastomeric ring configured to stretch around the outer perimeter of the exposed surface of the lightpipe with or without the customizable insert positioned between the lightpipe and the trim ring. According to an aspect, the indication of the color comprises an image including the color received from the application user device.

Certain aspects provide an ear cup assembly of a headphone comprising an ear cup subassembly comprising a light source, a reflector positioned on an outer surface of the ear cup subassembly, a lightpipe positioned on an outer surface of the reflector, and a semi-transparent trim ring positioned along an outer perimeter of an exposed surface of the lightpipe, wherein the trim ring is configured to at least partially overlay the ear cup subassembly, the reflector, and the lightpipe with or without a customizable insert positioned between the lightpipe and the trim ring, and wherein the light source is configured to change a color to illuminate the lightpipe and at least a portion of the trim ring.

According to an aspect, the ear cup subassembly is configured to receive an image, from a source device, capturing a color to illuminate the lightpipe and at least a portion of the trim ring. The light source is configured to change the color based on the received image.

Other features and advantages will be apparent from the description and the claims.

DETAILED DESCRIPTION

The present disclosure provides a headphone assembly with customizable ear cups. Specifically, a user is able to customize a color illuminated on an outer surface of an ear cup and/or select an insert through which a selected, illumined color is diffused. The customization features described herein allow a user to easily customize the color, insert, or combination of color and insert on ear cups of a headphone assembly. Accordingly, an end user is easily able to personalize a mass-produced headphone assembly.

Regarding color selection, a user may select a color to illuminate an external surface of an ear cup. The color may be selected from one of a plurality of pre-set colors stored in a memory of the headphone assembly. Additionally or alternatively, the colors may be stored externally to the headphone assembly and may be accessed via a wireless connection. The color may be selected by a user cycling through pre-set colors using a control on the headphone or by the user selecting a color using a GUI at a source device.

In aspects, a user may capture a desired color using a camera at a source device. The source device wirelessly transmits a request to display the captured color to the headphone assembly. In response, the headphone assembly processes the received image and illuminates a representation of the captured color. According to aspects, a user can mark one or more colors as favorites. Upon activation of a feature on the headphone assembly or the GUI, the headphone assembly cycles through the one or more colors the user identified as favorites. The user may easily select a color from a plurality of favorite colors.

In addition to selecting a color, a user may choose an insert to place on the ear cup. The insert may be made of a semi-transparent material, to allow light to pass through. According to aspects, the insert may have a pattern on the semi-transparent material. The light illuminated from the ear cup passes through the insert to further customize the appearance of the headphone assembly. To provide additional options, the user may use an insert made of any material, color, and, texture. As described herein, the insert may be secured on the ear cup by a trim ring. Advantageously, the design of the trim ring allows it to securely fit on the ear cup with or without the presence of an insert.

Figure 1:
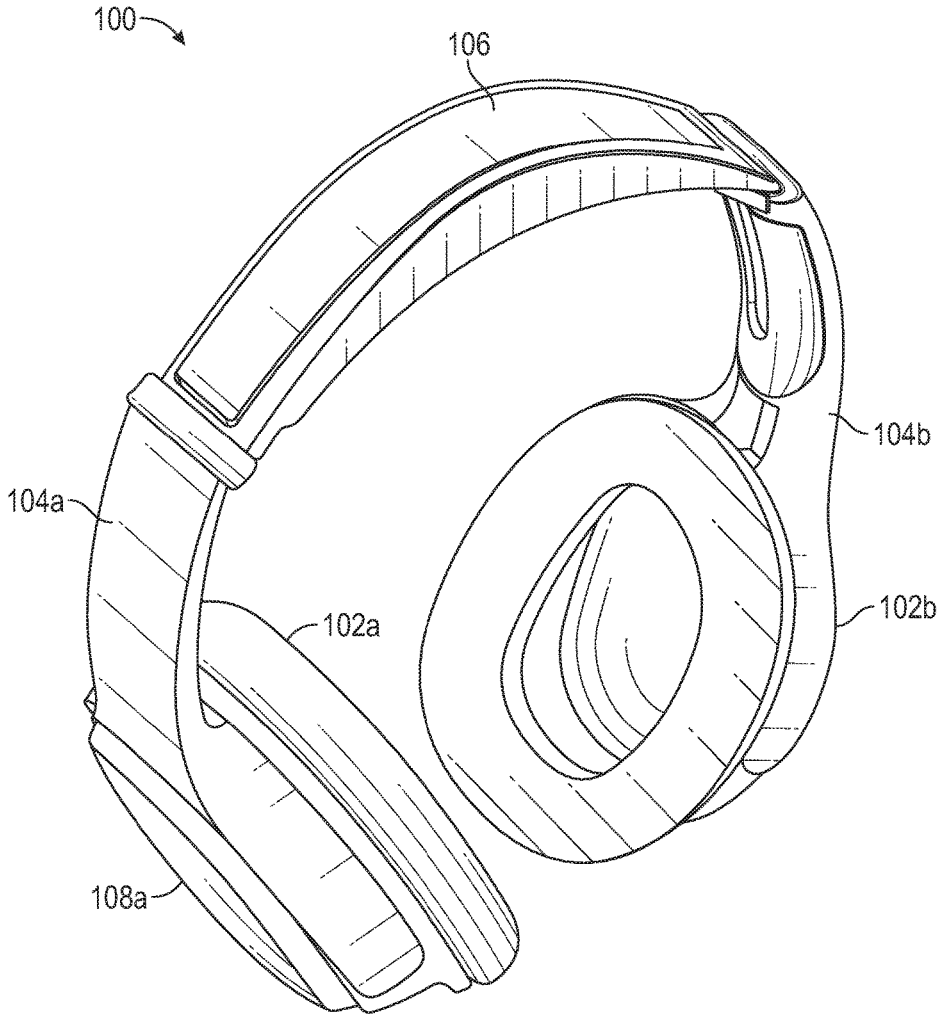
FIG. 1 illustrates a headphone assembly, in accordance with aspects of the present disclosure.

FIG. 1 illustrates an example headphone assembly 100, in accordance with aspects of the present disclosure. The headphone assembly 100 includes two ear cup assemblies 102*a*, 102*b* connected by an elongated headband. Each of the two ear cup assemblies 102*a*, 102*b* are loaded on to a different end of the headband using a yoke member 104*a*, 104*b*, respectively. In an aspect, the elongated headband is pre-formed in an arch shape to comfortably fit around a top of a user's head. Optionally, a headband cushion 106 covers the arched portion of the headband. Specific features of a headband cushion cover are described in application Ser. No. 15/982,019, titled "SNAPFOLD HEADBAND CUSHION," also filed May 17, 2018, which is expressly incorporated by reference in its entirety.

The headphone assembly 100 may include a wireless communication unit coupled to a processor and a memory configured to store instructions executable by the processor. The wireless communication unit is configured to wirelessly receive audio signals and commands from a source device. The source device includes any device capable of generating and transmitting audio signals or wireless commands to the headphone assembly. For example, the source device can be a mobile device such as a smartphone, a tablet computer, an e-reader, or a portable media player. The source device can also be a portable or non-portable media playing device such as a TV, a disk-player, a gaming device, a receiver, or a media streaming device. According to an example, the wireless communication unit of the headphone assembly establishes a wireless link with the source device in accordance with Bluetooth®, Bluetooth® Low Energy (BLE), Wi-Fi, or another personal area network (PAN) protocol.

The headphone assembly may include components of an active noise reduction (ANR) system. The headphone assembly may also include other functionality such as a microphone so the headphone assembly can function as a headset.

One or more ear cup customization features are used to illuminate an external surface of the ear cup assemblies 102*a*, 102*b*. 108*a* is an example of an external surface on the ear cup 102*a* that is customizable through color and/or insert selection. The ear cup 102*b* has a similar external surface that is not visible in FIG. 1.

Figure 2:
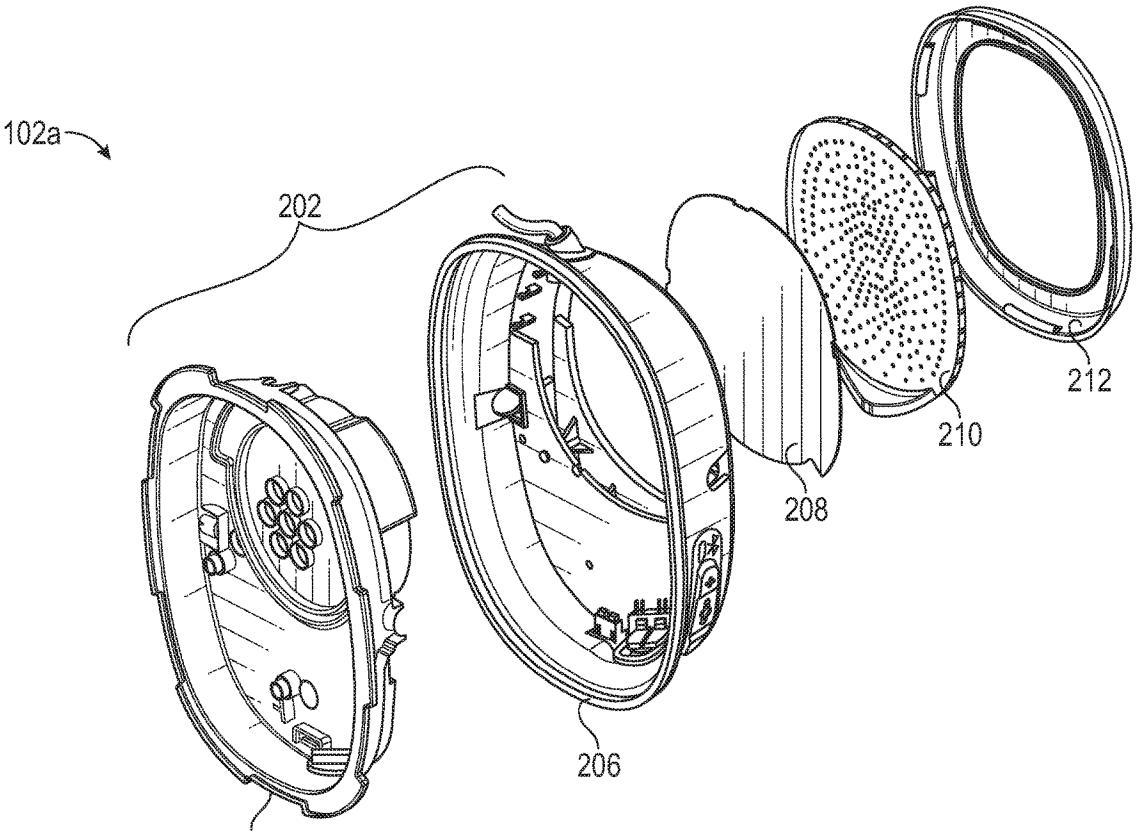
FIG. 2 illustrates an example exploded view of an ear cup assembly of a headphone assembly, in accordance with aspects of the present disclosure.

FIG. 2 illustrates an example exploded view of components of an ear cup assembly 102*a* of a headphone assembly, in accordance with aspects of the present disclosure. The ear cup assembly 102*a* includes an ear cup subassembly 202. The ear cup subassembly 202 comprises a driver subassembly 204 and a printed circuit board assembly (PCBA) 206.

According to aspects, the driver subassembly 204 includes a driver plate, an acoustic volume, and a driver. According to aspects, the PCBA 206 houses one or more light sources. For example, the PCBA is configured to secure a light source that provides an output to illuminate an outer surface of the ear cup assembly. In an example, the light source is a red, green, and blue (RGB) light emitting diode (LED). Additionally or alternatively, the PCBA 206 is configured to secure one or more switches used to control the headphone assembly. For example, the PCBA is designed to house one or more button holders and/or sliding controls that may turn the headphone assembly on and off, control the volume of an output of the headphone assembly, change a track played by the headphone assembly, search for a wireless source device external to the headphone assembly, and/or cycle through a number of preset or stored colors that may illuminate an outer surface of the ear cup assembly. In an example, the driver subassembly 204 may be screwed on or otherwise attached to the PCBA 206.

A reflector 208 is positioned on an outer surface of the ear cup subassembly 202. Specifically, the reflector 208 is positioned on an outer, exposed surface of the PCBA 206. According to an aspect, the reflector is a sticker, wherein the adhesive side of the reflector sticker is affixed on the exposed surface of the PCBA 206.

A lightpipe 210 is positioned on an outer surface of the reflector 208. The lightpipe 210 illuminates color output by the light source onto an outer surface 108*a* of an ear cup assembly 102*a*.

A trim ring 212 is removably positioned along an outer perimeter of the exposed surface of the lightpipe 210. Therefore, the trim ring 212 at least partially, overlays the ear cup subassembly 202, the reflector 208, and the lightpipe 210. As described herein, the trim ring 212 advantageously overlays the ear cup subassembly 202, the reflector 208, and the lightpipe 210 with or without a customizable insert placed between the lightpipe 210 and the trim ring 212.

While FIG. 2 illustrates an example exploded view of one ear cup assembly 102*a* of a headphone assembly, the ear cup assembly 102*b* may include similar components.

Figure 3B:
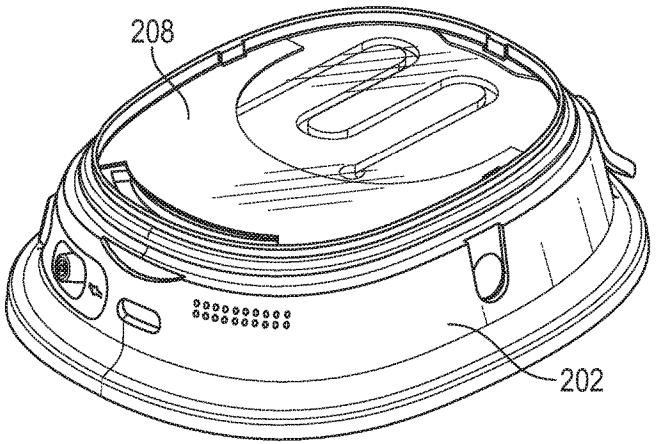
FIG. 3B illustrates the reflector shown in FIG. 3A positioned on the outer surface of an ear cup subassembly, in accordance with aspects of the present disclosure.
Figure 3A:
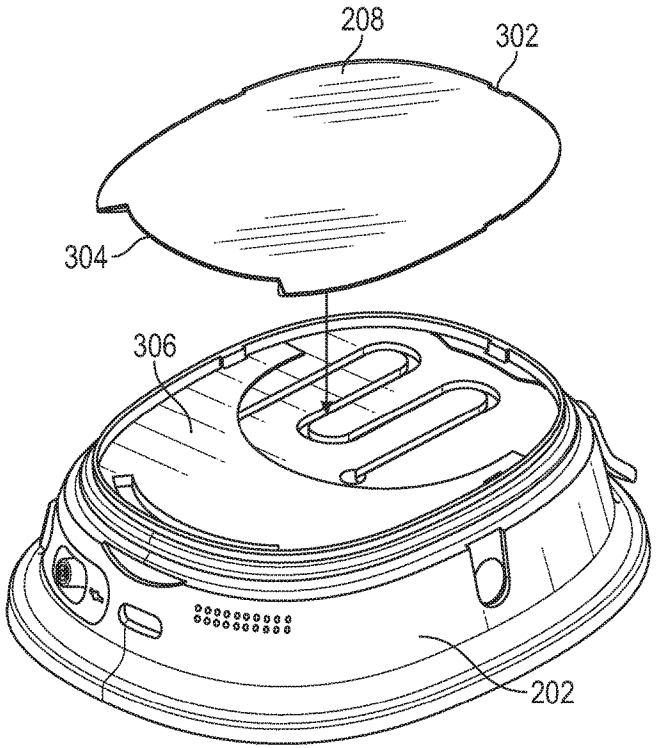
FIG. 3A illustrates an example reflector prior to positioning on an outer surface of an ear cup subassembly, in accordance with aspects of the present disclosure.

FIG. 3A illustrates a reflector 208 prior to positioning on an outer surface of an ear cup subassembly 202, in accordance with aspects of the present disclosure. The reflector 208 is designed to match and substantially cover the back face 306 of the surface the ear cup subassembly 202. Accordingly, the reflector has cutouts for snaps as shown as 302 and a cutout for the lightpipe 210 as shown at 304. Substantially covering the back face 306 of the ear cup subassembly 202 facilitates light from a light source, housed in the PCBA 206, to substantially illuminate most of an outer surface 108*a* of the ear cup assembly 102*a*.

FIG. 3B illustrates the reflector 208 positioned on the outer surface of an ear cup subassembly 202, in accordance with aspects of the present disclosure. As illustrated in FIG. 3B, the positioned reflector 208 substantially covers the back face of the ear cup subassembly 202.

In an example, the reflector 208 is a sticker made of a mylar material. The reflector is an opaque white color having a thickness of approximately 0.05 mm to 0.1 mm. In an example, the reflector is a smooth, contiguous surface that is free from holes. According to aspects, double sided adhesive is used to stick or attach the reflector to the back face of the ear cup subassembly 202. The double sided adhesive may be approximately 0.05 mm thick.

Figure 4B:
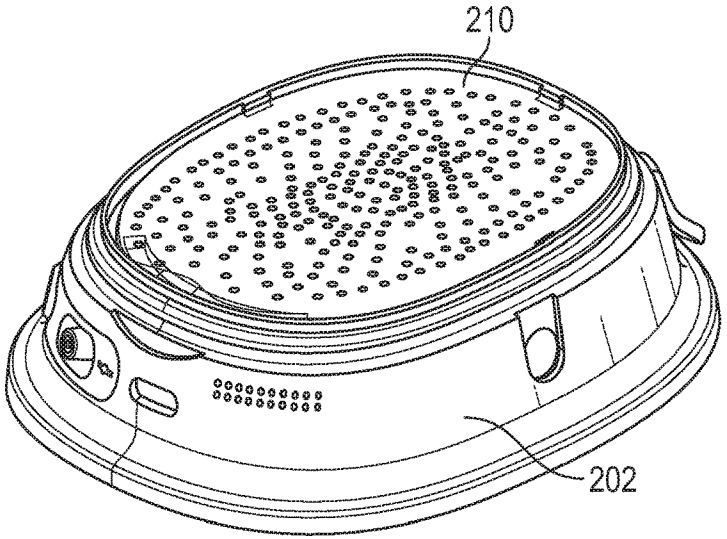
FIG. 4B illustrates the lightpipe shown in FIG. 4A positioned on the outer surface of the reflector, in accordance with aspects of the present disclosure.
Figure 4A:
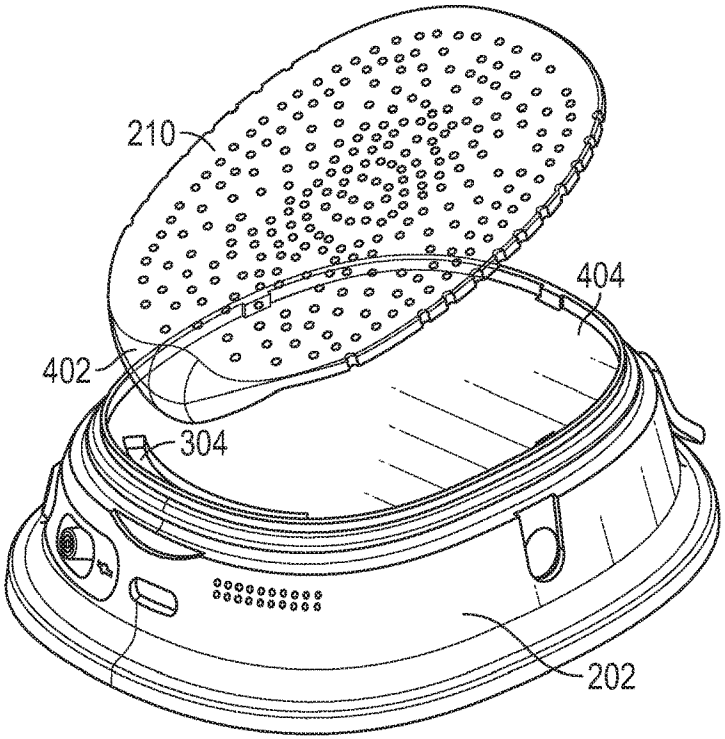
FIG. 4A illustrates an example lightpipe prior to positioning on an outer surface of the reflector, in accordance with aspects of the present disclosure.

FIG. 4A illustrates the lightpipe 210 prior to positioning on an outer surface of the reflector 208, in accordance with aspects of the present disclosure. The lightpipe 210 is designed to match and substantially cover an exposed surface 404 of the reflector 208 positioned on the ear cup subassembly 202. Substantially covering the exposed portion of the reflector facilitates illumination of light from a light source on to most of an outer surface 108*a* of the ear cup assembly 102*a*.

The lightpipe 210 includes one or more snap features to secure it to the reflector 210. The lightpipe 210 is designed with a feature 402 that extends through the cutout 304 of the reflector 208. The feature 402 has an opening that receives light from the light source housed in the PCBA 208. The lightpipe 210 routes light from the light source to illuminate the outer surface 108*a* of the ear cup assembly 102*a*. In an example, the lightpipe 210 has small openings or holes on the surface to help distribute the light.

FIG. 4B illustrates the lightpipe 210 positioned on the outer surface of the reflector 208, in accordance with aspects of the present disclosure. The lightpipe 210 substantially, if not completely, covers the reflector 208.

Figure 5A:
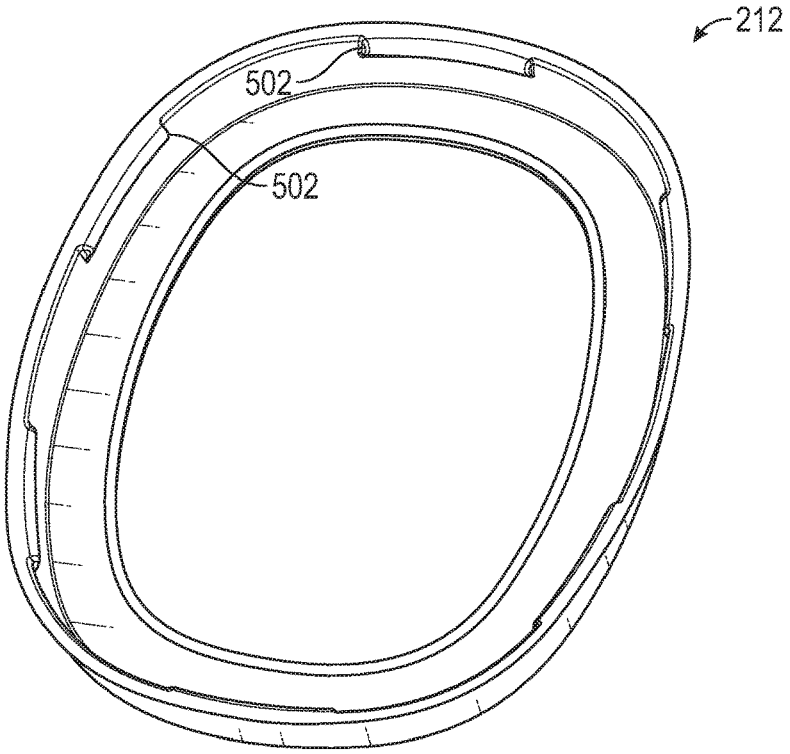
FIG. 5A illustrates an internal side of an example trim ring including snap features configured to contact the ear cup subassembly, in accordance with aspects of the present disclosure.

FIG. 5A illustrates an internal side of an example trim ring 212 configured to contact the ear cup subassembly 202, in accordance with aspects of the present disclosure. In an aspect, the trim ring includes one or more snap features 502 to secure the trim ring to the ear cup subassembly 202.

Figure 5B:
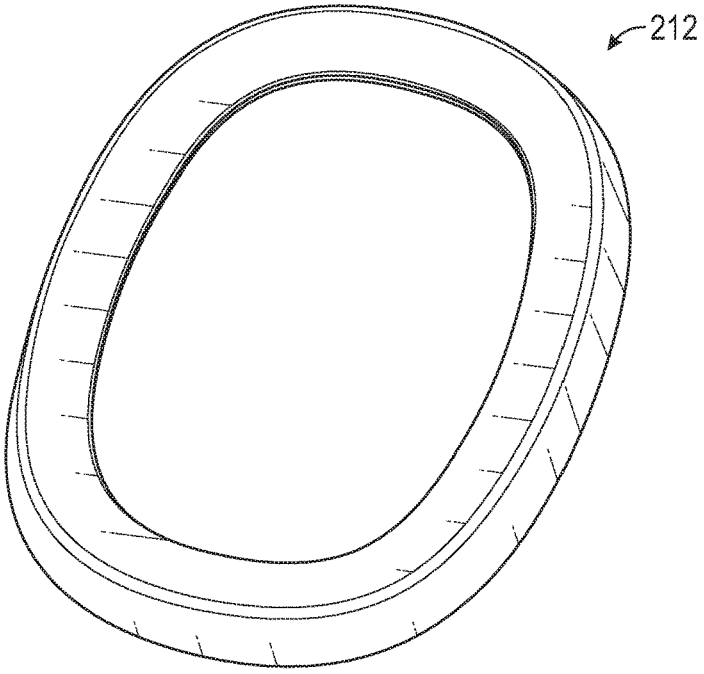
FIG. 5B illustrates an external side of the trim ring shown in FIG. 5A, wherein the external side contacts user's ear, in accordance with aspects of the present disclosure.

FIG. 5B illustrates an external side of the trim ring 212, wherein the external side contacts of user's ear when the headphone assembly 100 is positioned on the user's head, in accordance with aspects of the present disclosure.

The trim ring 212 is made of a material having elastic properties. For example, the trim ring may be made of a thermoplastic elastomer or silicone. The trim ring is clear or semi-transparent, thereby allowing light to pass through. In an aspect, the trim ring is approximately 1.5 mm thick.

The trim ring 212 stretches around an outer perimeter of an exposed surface of the lightpipe. Advantageously, the trim ring 212 fits along the outer perimeter of the lightpipe 210 regardless of the presence of an insert positioned between the lightpipe and the trim ring 212. In an aspect, the trim ring 212 is designed with one or more undercuts to help the trim ring flexibly secure an insert to the lightpipe or stay secured on the lightpipe absent the use of an insert. The insert is described in more detail with reference to FIG. 6.

The trim ring is clear or semi-transparent, thereby allowing light to pass through. In an aspect, the trim ring is approximately 1.5 mm thick.

Figure 6:
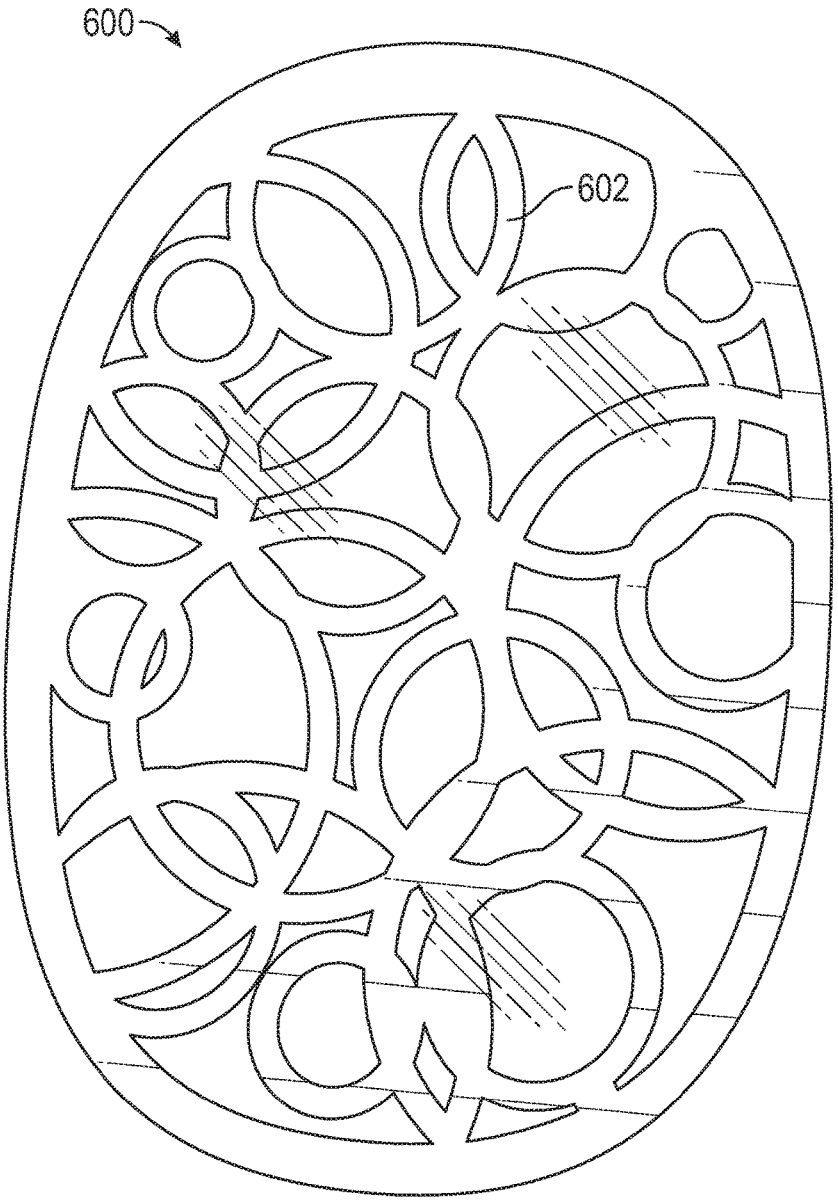
FIG. 6 illustrates an example of a semi-transparent removable insert, in accordance with aspects of the present disclosure.

FIG. 6 illustrates an example of a semi-transparent removable insert 600, in accordance with aspects of the present disclosure. The insert 600 is placed on top of the lightpipe to diffuse the light output from the light source and illuminated on the outer surface 108*a* of the ear cup assembly 102*a*. The insert is designed to substantially cover the lightpipe and is held in place on the headset assembly 100 by the trim ring. A selected light color illuminated through the ear cup assembly 102*a* will diffuse through the design 602 of the insert 600 to further customize the appearance of the headphone assembly 100. While a 2-dimensional design is illustrated in FIG. 6, the insert may have no design, or a 3-dimensional design. According to aspects, the insert may be made of any material. For example, the insert may be fabric. Additionally or alternatively, the material may have varying texture. The insert may have varying thickness, wherein the thickness is approximately less than or equal to 1.5 mm.

Figure 7:
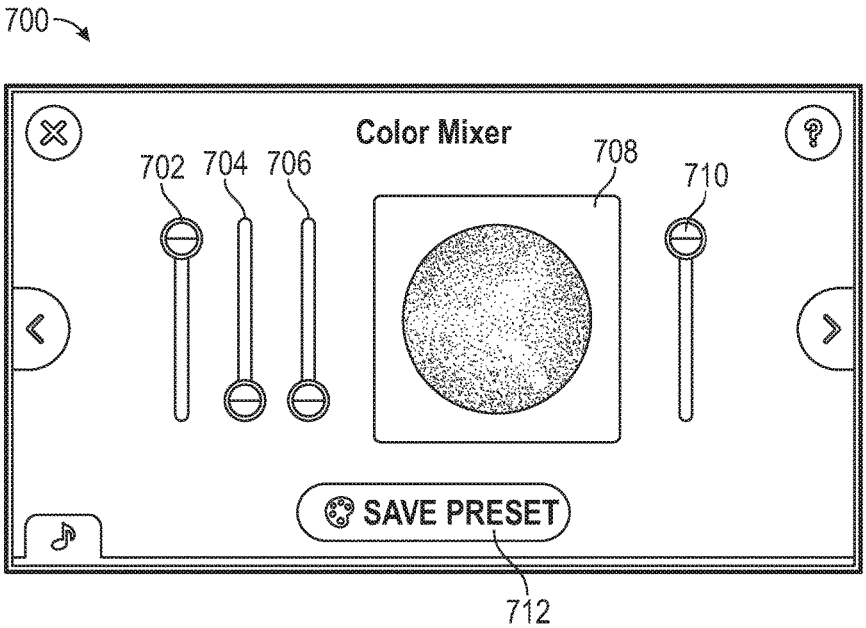
FIG. 7 illustrates an example of a graphical user interface (GUI) for selecting a color to be displayed on an outer surface of the ear cup assembly of the headphone assembly, in accordance with aspects of the present disclosure.

FIG. 7 illustrates an example of a GUI 700 at a source device for selecting a color to be displayed on an outer surface 108*a* of the ear cup assembly 102*a* of the headphone assembly 100, in accordance with aspects of the present disclosure. As described above, the headphone assembly 100 may wirelessly communicate with a source device. An application at the source device may display a GUI that allows a user to select one of a number of pre-set colors to illuminate an outer surface of an ear cup assembly 102*a*. In an example, the GUI displays a number of colors and a user may select a color using the GUI. The source device may transmit a request to change a color output by the light source and displayed on an outer surface of the ear cup assembly. In response to receiving a request to change or update the color, a processor at the headset assembly is configured to control a light source to output the selected color.

In one example, the color is selected from a combination of pre-set colors. As illustrated in FIG. 7, a user may create one or more colors, by varying the amount of red 702, green 704, and/or blue 706 in a created color. The user may vary the amount of red, green, and blue by adjusting a respective color slider displayed on the GUI. The user may adjust the amount of black or white in the created color using the slider 710. As the user varies the red, green, and blue components, and/or the darkness of the color, the color display 708 updates to provide the user with a visual indication of the created color.

The user may save a created color using the save preset 712 option. According to an aspect, a user saves a number of favorite colors using the save preset 712 feature. Thereafter, the user may access the saved colors via the application and/or headphone to easily select a color from among one of the saved colors.

Figure 8:
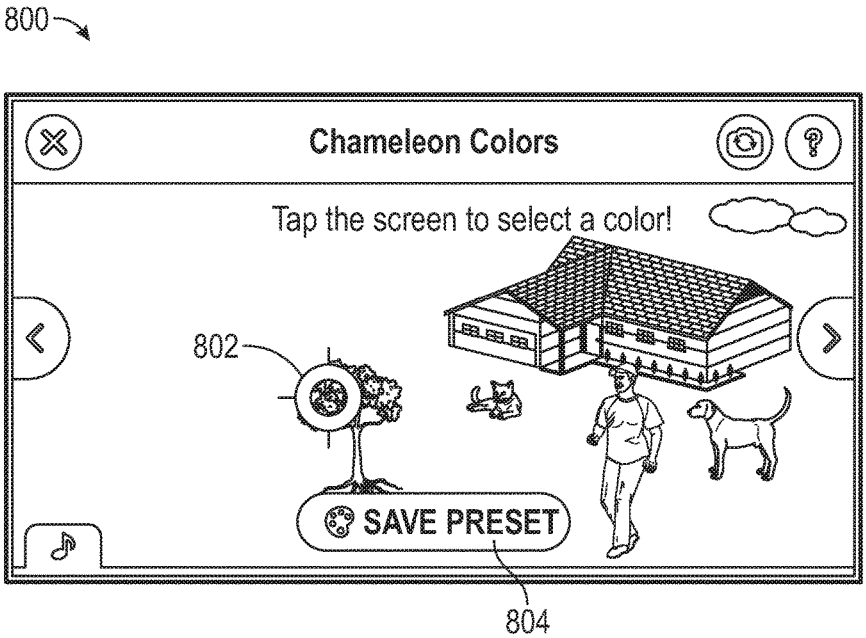
FIG. 8 illustrates an example of a GUI for capturing a color to be displayed on an outer surface of the ear cup assembly of the headphone assembly, in accordance with aspects of the present disclosure.

FIG. 8 illustrates an example of a GUI 800 for capturing a color to be displayed on an outer surface of the ear cup assembly 102*a* of the headphone assembly, in accordance with aspects of the present disclosure. In an aspect, a source device is used to capture an image of a color to be illuminated on an outer surface of an ear cup assembly. A user uses a camera of the source device to view and capture the desired color. In an example, the user touches and drags cross-hairs 802 to move the cross-hairs to the specific location to center on a desired color. The user may tap the cross-hairs 802 to capture the color in the middle of the cross-hairs. The user may save the captured color using the save preset 804 feature.

According to an aspect, a user saves a number of favorite colors using the save preset 712 feature and/or the save preset 804 feature. Thereafter, the user may access the saved colors via the application and/or headphone to easily select a color from among one of the saved colors.

In an example, the headphone assembly 100 includes a button that when activated, cycles through the saved favorite colors or a number of recently-used colors. The colors may be any combination pre-set colors, created colors, and captured images of colors. In an example, the user may press the button and the headphone assembly 100 may cycle through the user's identified saved favorite colors. The user may activate another button to select the desired, saved color.

In an example, the headphone assembly announces a name of a color as the respective color is illuminated on the surface of the ear cup assembly 102*a*. Using text-to-speech voice prompts, a user is able to enter in a color name associated with a color and the headphone assembly is configured to announce the stored color name as it cycles through preset colors. According to aspects, after the user has selected a color to be illuminated on the surface of the ear cup assembly 102*a*, the headphone assembly is configured to announce the name of the selected color. Announcing a name of a color as it is displayed on the surface of the ear cup and announcing the name of a selected color allows the user, who is potentially wearing the headphone assembly, to know what customization lighting preset is displayed/selected without a user taking off the headphone assembly and/or without use of the application on a source device displaying the customization lighting preset.

In an example, the application may display images of the saved color, and the user may select the desired color. A user selecting a color (preset, created, or captured) triggers a transmission by the source device to the headphone assembly 102*a* to change a color displayed by the light source. Specifically, within the headphone assembly 100, a wireless communication unit 100 receives the command and a processor processes the command to change or update a color displayed by the light source and therefore illuminated by the lightpipe. The processor is configured to change or update the color to match the user's color selection.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. An ear cup assembly of a headphone assembly comprising:

an ear cup subassembly;

a reflector positioned on an outer surface of the ear cup subassembly;

a lightpipe positioned on an outer surface of the reflector; and a trim ring positioned along an outer perimeter of an exposed surface of the lightpipe, wherein the trim ring is configured to at least partially overlay the ear cup subassembly, the reflector, and the lightpipe with or without a customizable insert positioned between the lightpipe and the trim ring.

2. The ear cup assembly of claim 1, wherein the trim ring comprises an elastomeric ring configured to stretch around the outer perimeter of the exposed surface of the lightpipe with or without the customizable insert positioned between the lightpipe and the trim ring.

3. The ear cup assembly of claim 1, wherein at least a portion of the trim ring is in contact with an outer perimeter of the ear cup subassembly.

4. The ear cup assembly of claim 1, wherein a thickness of the customizable insert is less than or equal to approximately 1.5 mm.

5. The ear cup assembly of claim 1, wherein the customizable insert comprises a semi-transparent insert.

6. The ear cup assembly of claim 1, wherein the customizable insert comprises an insert including a pattern that diffuses light illuminated from the lightpipe.

7. The ear cup assembly of claim 1, wherein a thickness of the trim ring is approximately 1.5 mm.

8. The ear cup assembly of claim 1, wherein the trim ring comprises a silicone trim ring.

9. The ear cup assembly of claim 1, further comprising:

a light source and at least one processor, wherein the light source is coupled to the at least one processor and the lightpipe; and a wireless communication unit coupled to the at least one processor, wherein the wireless communication unit is configured to receive, from a source device, a request to change a color displayed by the light source and illuminated by the lightpipe, and wherein the at least one processor is configured to update an output of the light source based at least in part on the received request to change the color.

10. The ear cup assembly of claim 9, wherein the color is selected from a combination of preset-colors.

11. The ear cup assembly of claim 9, wherein the wireless communication unit is configured to:

receive a request to save one or more colors to be displayed by the light source as favorite selections;

receive a command to cycle through the favorite selections;

receive a user selection of one color from the favorite selections; and control the light source to illuminate the selected color.

12. The ear cup assembly of claim 9, wherein the request to change the color comprises a captured image comprising the color to be displayed by the light source.

13. The ear cup assembly of claim 9, wherein the request to change the color comprises one of: discrete red, green, and blue values representing the color, or a singular value corresponding to the color in a lookup table.

14. The ear cup assembly of claim 9, wherein the wireless communication unit is further configured to receive, from the source device, a request to save the updated color, and wherein the ear cup assembly saves the updated color in response to the request.

15. An ear cup assembly of a headphone comprising:

an ear cup subassembly;

a reflector positioned on an outer surface of the ear cup subassembly;

a lightpipe positioned on an outer surface of the reflector; and a semi-transparent trim ring positioned along an outer perimeter of an exposed surface of the lightpipe, wherein the trim ring is configured to at least partially overlay the ear cup subassembly, the reflector, and the lightpipe with or without a customizable insert positioned between the lightpipe and the trim ring, and wherein the ear cup assembly receives an indication of a color from an application user device and processes the indication to determine at least one color to illuminate the lightpipe.

16. The ear cup assembly of claim 15, wherein the at least one color illuminates at least a portion of the trim ring and at least a portion of the trim ring is in contact with an outer perimeter of the ear cup subassembly.

17. The ear cup assembly of claim 15, wherein the trim ring comprises an elastomeric ring configured to stretch around the outer perimeter of the exposed surface of the lightpipe with or without the customizable insert positioned between the lightpipe and the trim ring.

18. The ear cup assembly of claim 15, wherein the indication of the color comprises an image including the color received from the application user device.

19. An ear cup assembly of a headphone comprising:

an ear cup subassembly comprising a light source;

a reflector positioned on an outer surface of the ear cup subassembly;

a lightpipe positioned on an outer surface of the reflector; and a semi-transparent trim ring positioned along an outer perimeter of an exposed surface of the lightpipe, wherein the trim ring is configured to at least partially overlay the ear cup subassembly, the reflector, and the lightpipe with or without a customizable insert positioned between the lightpipe and the trim ring, and wherein the light source is configured to change a color to illuminate the lightpipe and at least a portion of the trim ring.

20. The ear cup assembly of claim 19, wherein the ear cup subassembly is configured to:

receive an image, from a source device, capturing a color to illuminate the lightpipe and at least a portion of the trim ring, wherein the light source is configured to change the color based on the received image.

* * * * *